United States Patent [19]

Shin-Shi

[11] Patent Number: 4,530,039

[45] Date of Patent: Jul. 16, 1985

[54] MULTI-SECTION MULTI-PURPOSE HAND LIGHT

[76] Inventor: Steve S. Shin-Shi, 2-6th Flr., 13 Lane 118, Chung Ching S. Rd., Sec. 1, Taipei, Taiwan

[21] Appl. No.: 537,076

[22] Filed: Sep. 29, 1983

[51] Int. Cl.[3] ..... F21L 7/00

[52] U.S. Cl. ..... 362/158; 362/184; 362/186; 362/187; 362/202; 362/207; 362/267; 362/268; 362/293; 362/280; 362/319; 362/359; 362/449

[58] Field of Search ..... 362/202, 293, 267, 207, 362/158, 184, 203, 204, 205, 206, 186, 280, 268, 319, 359, 449

[56] References Cited

U.S. PATENT DOCUMENTS

| | | | |
|---|---|---|---|
| 2,225,825 | 12/1940 | Desimone | 362/186 |
| 2,342,470 | 2/1944 | Hunt | 362/293 X |
| 2,361,480 | 10/1944 | Joffo | 362/293 X |
| 3,265,880 | 8/1966 | Whitman | 362/207 |
| 3,579,269 | 5/1971 | Ostensen | 362/158 |
| 3,944,804 | 3/1976 | Wisdom | 362/280 |

FOREIGN PATENT DOCUMENTS

| | | | |
|---|---|---|---|
| 826127 | 4/1981 | U.S.S.R. | 362/202 |

*Primary Examiner*—Stephen J. Lechert, Jr.

[57] ABSTRACT

A multi-section multi-purpose hand light incorporates a shade casing, a head cover, a refraction hood, red filter lens and a body comprised of a number of cylindrical sections. The red filter lens can be releasably fastened to the retractable refraction hood. The light being emitted thereby will be a focused red light beam surrounded by an aureole of white light. This hand light may serve as a striking signal for help where needed to facilitate search and rescue efforts by a tracing team. The intensity of illumination can be increased by an increased number of the cylindrical sections. Spare bulbs or replacement parts can be stored in the bottom section of the body. The hand light also serves as a regular hand light by removing the red filter lens from the hood and coupling it to the bottom section of the hand light.

6 Claims, 1 Drawing Figure

MULTI-SECTION MULTI-PURPOSE HAND LIGHT

SUMMARY OF THE INVENTION

The present invention provides for a multi-section multi-purpose hand light comprising a casing, a head cover, a refraction hood, a red filter lens and a body consisting of a number of cylindrical sections. The hand light may be adapted to focus a red light beam on a level surface by virtue of the action of the red filter lens provided on the head cover. Light passing through the transparent refraction hood results in distribution of the light over the same level surface so that the focused red beam is surrounded by an aureole of white light.

This combination of the red light beam surrounded by the aureole of white light serves as a striking help signal to assist search and rescuing parties.

All the cylindrical sections of the body may be screw-threadedly secured to each other and each section corresponds substantially to the length of, and is adapted to accommodate, a cell. In this way, the intensity of illumination can be increased by increasing the number of cylindrical sections.

The hand light of the invention is easy to carry and may also serve in the capacity of an ordinary hand light by removing the red light filter lens from the head cover as required.

An object of the present invention is to provide a multi-section multi-purpose hand light featuring the provision of a unique refraction hood and red light filter lens provided on the head cover, such that the light being emitted by the hand light, on being subjected to the refraction action by the refraction hood and photo-filtering action by the filter lens, will produce a concentrated, striking red light beam surrounded by a large aureole of white light to serve as a conspicuous signal for help by the user in case of an emergency. In this way, any airborne rescuing parties, for instance, aboard a helicopter will have a better chance of locating the user, at night in particular. The user, when in an endangered situation, may further flash such a striking light illumination comprising both the red and the white beams in the direction of the vessel or ship in sight so that the people aboard that vessel or ship may take rescuing actions. The present invention may further find applications in mountain climbing activities or other areas where there is a possibility that the user may have to ask for help in case of emergency.

A further object of the present invention is the provision of the multiple section construction of the body each section being furnished with threads for coupling with an adjacent section and corresponding with the length of a cell therefor. In this way, the number of sections may be adjusted to attain the required intensity of illumination. In addition, the availability and easy adjustment of the number of sections enhances the portability. Further, spare bulbs may be stored in the hand light to ensure the availability of replacements when necessary.

As mentioned, the hand light will also serve very well as an ordinary hand light by removing the red filter lens from the notched cavities and sliding the casing over the body. In this way, the illumination will be concentrated to give a far-reaching beam as does a regular hand light.

DETAILED DESCRIPTION OF THE DRAWING

Figure 1:
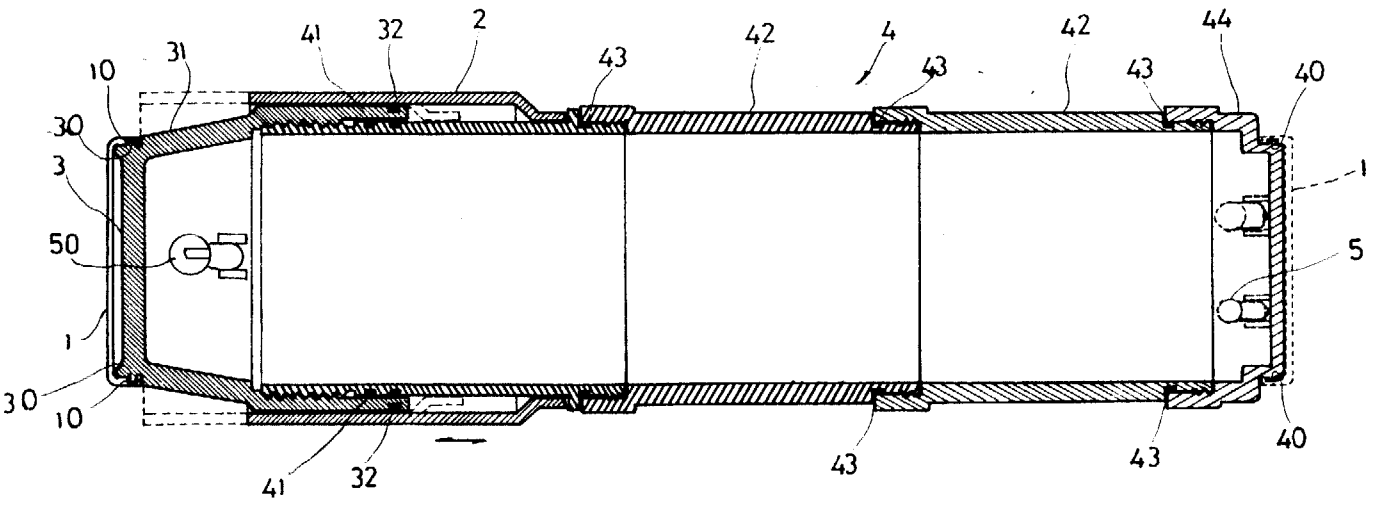
FIG. 1 is a cross-sectional view of the hand light of the invention.

The hand light of the invention includes a red filter lens 1 provided over a refraction hood 31 of the head cover 3, such that light being emitted from the light source 50, through the refraction hood 31 will be distributed in an aureole of white light between the head 31 and the shade casing 2. Light will also pass through the red filter lens 1 and will be seen as the central red light beam.

On the inside edge of the red filter lens there is provided a notched cavity 10 for snapping against the protrusions 40 provided on the bottom of the body after removing the red filter lens 1 from the head cover 3. The hand light can in this way be used as a regular hand light.

By sliding the shade casing 2 coaxially relative to the body 4 the distance of illumination can be controlled. The head cover 3 is connected to the red filter lens 1 by means of an arched crest 30 provided on either side thereof. Adjacent the crest 30 is a transparent refraction hood 31 serving to refract and divert the illumination. Beneath the refraction hood 31 there is provided a rubber ring 32 engaged to the shade casing 2 so that the shade casing 2 may be moved longitudinally in a balanced condition. The body 4, consisting of a number of sections, serves as a framework of the invention, and is provided with effective water tight rubber rings 41. The multi-section body 4 incorporates a number of cylindrical sections 42 each corresponding to the length of a cell therefor. The whole body 4 looks like a bamboo trunk with excellent water resistant properties due to the provision of a water-tight rubber ring 43 on the coupling threads of each section 42.

The intensity of illumination may be adjusted by varying of the number of sections 42 as required. The bottom section 44 may serve as a storage area for bulbs 5 or spare replacement parts where necessary.

The present invention will serve as a striking help signal or mark for releasing a conspicuous illumination pattern to catch the attention of a rescuing team in case of emergency facing the user. In addition, it will serve as a regular hand light. Moreover, variation of the intensity of illumination and the coverage range thereof is possible by virtue of discreet cylindrical sections which can be easily removed or inserted.

What is claimed is:

1. A hand light comprising:

an elongate body having a forward end and a rear end and including a plurality of open-ended sections arranged end to end, the length of the body being adjustable by varying the number of sections constituting the body;

a transparent refraction hood fixed to and extending away from the forward end of the body in tapering fashion;

a transparent head cover fixed to the refraction hood over its free end;

a source of light in the body which emits light into the space defined by the refraction hood and the head cover;

a shade casing having a front edge and fixed to the forward end of the body, the casing being capable of sliding telescopic-like movement relative to the body between an extended position wherein the front edge of the casing extends beyond the forward end of the body to surround the refraction hood, and a withdrawn position wherein substantially the entire casing surrounds the body; and a color filter lens releasably connected to the head cover, whereby the illumination pattern when the lens is connected to the head cover and the shade casing is in the extended position consists of a central color beam surrounded by an annular beam of white light.

2. A hand light as claimed in claim 1 further comprising rubber rings between the joins of the sections which make up the body.

3. A hand light as claimed in claim 1 further comprising a rubber ring seal between the shade casing and the refraction hood, the ring being fixed and the shade casing being capable of sliding thereover.

4. A hand light as claimed in claim 1 further comprising protrusions at the rear end of the body upon which the filter lens can be releasably fastened when not positioned over the head cover.

5. A hand light as claimed in claim 1 wherein the filter lens is red.

6. A hand light as claimed in claim 1 wherein the head cover is substantially flat and is fixed to the refraction hood such that the plane of the cover is substantially normal to the longitudinal axis of the body.

* * * * *